US006772459B2

(12) United States Patent
Nixon et al.

(10) Patent No.: US 6,772,459 B2
(45) Date of Patent: Aug. 10, 2004

(54) SIDE FRAME FOR A COT OR BED

(75) Inventors: Jack Nixon, Halifax (GB); Graham Roper, Halifax (GB)

(73) Assignee: Siddall & Hilton Limited (GB)

( * ) Notice: Subject to any disclaimer, the term of this patent is extended or adjusted under 35 U.S.C. 154(b) by 0 days.

(21) Appl. No.: 10/381,080

(22) PCT Filed: Sep. 20, 2001

(86) PCT No.: PCT/GB01/04208

§ 371 (c)(1),
(2), (4) Date: Mar. 19, 2003

(87) PCT Pub. No.: WO02/26085

PCT Pub. Date: Apr. 4, 2002

(65) Prior Publication Data

US 2003/0177578 A1 Sep. 25, 2003

(30) Foreign Application Priority Data

Sep. 28, 2000 (GB) ..... 0023742

(51) Int. Cl.[7] ..... A47C 21/08
(52) U.S. Cl. ..... 5/429; 5/93.1; 5/100
(58) Field of Search ..... 5/93.1, 100, 429

(56) References Cited

U.S. PATENT DOCUMENTS 754,140 A * 3/1904 Hollis ..... 5/100
2,804,631 A * 9/1957 Levin ..... 5/100
3,193,849 A * 7/1965 Landry ..... 5/100
3,193,850 A * 7/1965 Landry ..... 5/100
4,934,007 A 6/1990 Sweet
5,134,734 A * 8/1992 Bozino ..... 5/100
5,884,348 A * 3/1999 Onishi et al. ..... 5/93.2
5,926,870 A 7/1999 Branca-Barnes et al.

FOREIGN PATENT DOCUMENTS

| | | |
|---|---|---|
| GB | 637951 | 5/1950 |
| TW | 376719 | 12/1999 |
| WO | WO0042884 | 7/2000 |

* cited by examiner

*Primary Examiner*—Teri Pham Luu
(74) *Attorney, Agent, or Firm*—Trexler, Bushnell, Giangiorgi, Blackstone & Marr, Ltd.

(57) ABSTRACT

A side frame (1) for a cot (2) or bed (20), particularly, but not exclusively, for hospital use, comprising upper and lower rails (3, 4) located in spaced-apart, parallel relationship and of length required for the side frame (1), with the rails (3, 4) inter-connected by a plurality of spaced-apart, transversely extending, telescopic struts (7), with a third parallel rail (10) interposed between the two parallel rails (3, 4) and with an outer tube or cylinder of each telescopic strut (7) slidable through suitable holes or apertures (11) in the third rail (10). A modified side frame (1A) comprises at least one biassing strut, eg in the form of a gas strut (7A), capable of maintaining the side in a fully, or partially, deployed positions, with means for manually rendering the biassing strut (7A) inoperative when retraction, by lowering the side (1A), is required. The invention also includes a cot (2) provided with at least one side frame (1), and a bed (20) provided with at least one modified side frame (1A).

14 Claims, 4 Drawing Sheets

SIDE FRAME FOR A COT OR BED

RELATED/PRIORITY APPLICATION

Figure 1:
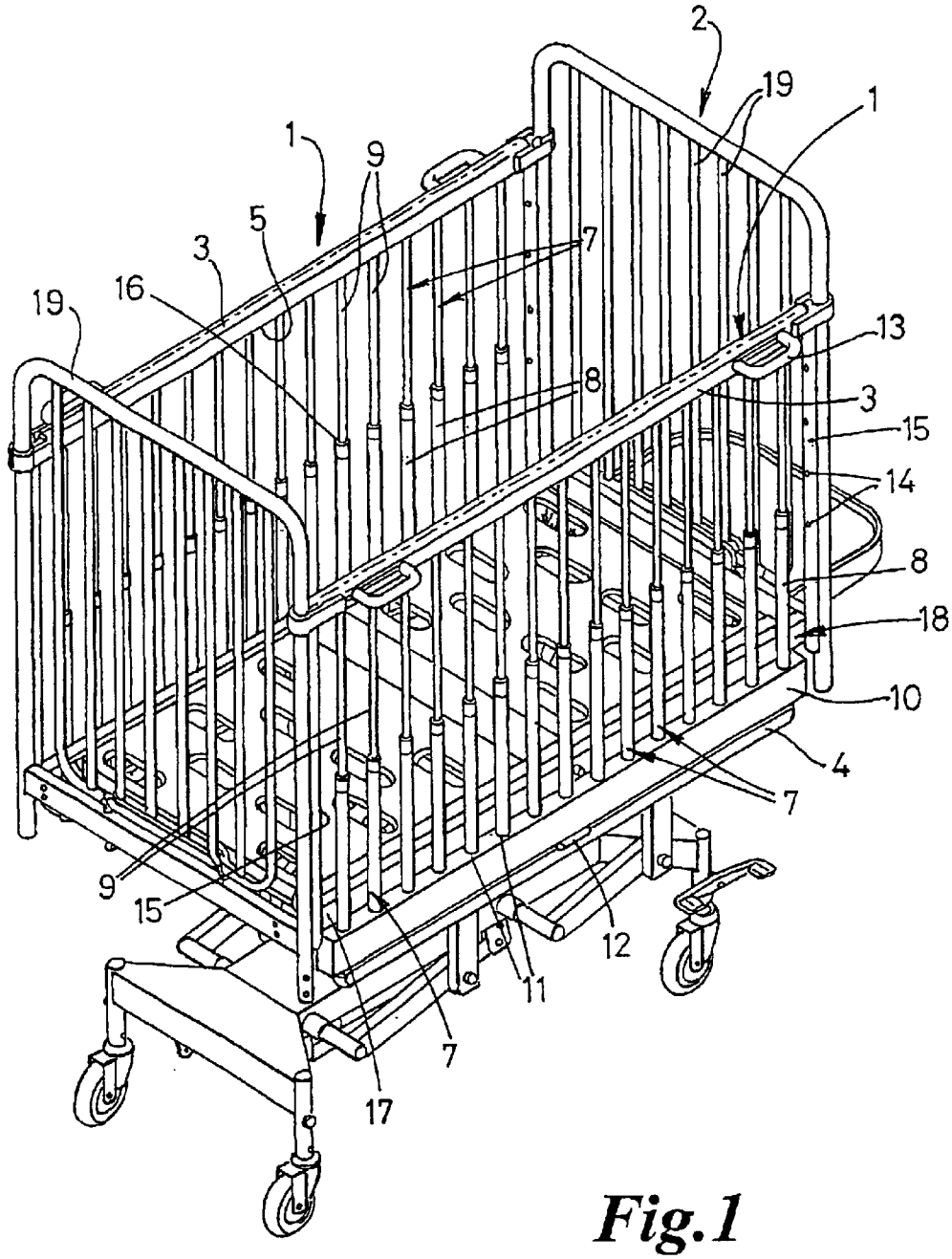

This application is a National Phase Application of PCT/GB01/04208, filed Sep. 20, 2001, which claims priority with respect to British Application No. 0023742.0, filed Sep. 28, 2000.

FIELD OF THE INVENTION

This invention relates to a side frame for a cot or bed, particularly but not exclusively for hospital or care home use or domestic use, and to a cot or bed incorporating at least one such side frame.

BACKGROUND OF THE INVENTION

A standard requirement for cots, for paediatric use or for use with patients of all ages dependent upon care need, is for the presence of upwardly extending side frames to constrain a possibly unconscious patient to the area of the cot. For the unobstructed performance of nursing care such side frames need ideally to be absent, and consequently one standard construction is for a side frame to be provided with horizontal axis hinges at approximately its mid-height of the side frame, so that an upper portion may be rotated through 180° between a deployed position, for maximum patient containment, and a non-deployed position for patient access and/or minimal containment, with user-operable retaining latches to latch the top half at least in its upper, deployed position. As a side frame is typically approximately 2 ft (0.6 m) in height, rotation requires a minimum lateral clearance of 1 ft (0.3 m). An alternative system is a side frame that may be moved in a vertical plane between an upper, deployed position, and a lower "access" position, again with user-operable retaining latches. This system is used extensively in infant's domestic cots constructed of timber, where a side frame is of relatively light weight and can readily be lifted along slide guides to its deployed position. However, hospital type cots are invariably constructed from metal tubing due to the need for durability over a reasonable service life, a side frame even of 4–5 ft (1.2 m–1.5 m) length presents a considerable weight, sometimes requiring the installation of a power means, with attendant cost penalty, to effect lifting of the side frame to its upper, deployed position.

Furthermore, there is an increasing demand for variable height cots so that nursing or care staff may locate the patent at optimum height, but fixed size side frames do not readily permit use with variable height cots.

In GB 637951 is described a cot with a drop down side frame, particularly for infants, in which the space requirement for the side frame in its dropped position, is minimised by the use of telescopic struts to reduce the height of the side frame in its dropped position.

In WO 00/42884 is described a wheeled stretcher which has side frames capable of telescoping between an upper position and a lower position, depending on the patient's needs.

OBJECT OF THE INVENTION

A basic object of the invention is the provision in a first aspect of an improved side frame for a cot or bed, and in a second aspect of a cot or bed incorporating at least one such side.

SUMMARY OF A FIRST ASPECT OF THE INVENTION

According to a first aspect of the invention, there is provided a side frame for a cot or bed, particularly, but not exclusively, for hospital use, comprising upper and lower rails located in spaced-apart, parallel relationship and of length required for the side frame, with the rails interconnected by a plurality of spaced-apart, transversely extending, telescopic struts, and with a third, parallel rail interposed between the upper and lower rails and with an outer tube or cylinder of each strut slidable through apertures in the third rail.

SUMMARY OF A SECOND ASPECT OF THE INVENTION

According to a second aspect of the invention, there is provided a cot or bed, particularly, but not exclusively, for hospital use, comprising at least one side frame in accordance with the first aspect.

ADVANTAGE(S) OF THE INVENTION

With the side frame in accordance with the invention, e.g. for hospital, care home or domestic use, the third rail is attached in a fixed position to the cot or bed, e.g. by being bolted or screwed to the mattress support frame, so that, to lower the side frame from a fully deployed position, in a first stage, the struts are contracted, to give partial access/constraint, and if full access, zero constraint is required, then in a second stage the cylinders are pushed through the apertures of the third rail, the lower rail is lowered into close proximity with the floor, until the upper rail is in close proximity to, or abuts, the third rail, and the side frame thus presents zero, or minimal, obstruction to the mattress and/or patient.

It follows that the side in accordance with the invention, gives the medical staff or carer, the option of selecting, e.g. 50%, obstruction/access in a semi-deployed position, and 100% obstruction in a fully deployed position, and zero obstruction/maximum access in a fully retracted position.

Furthermore, because all positional adjustment movements of the side frame would, in practice, be in a vertical plane, minimal lateral clearance is required for positional changes of the side frame.

PREFERRED FEATURES OF THE INVENTION

The struts are metallic.

The struts are timber.

The struts are of plastics.

The struts comprise in one embodiment an inner tube and an outer tube of similar length.

The struts each comprise in another embodiment an inner rod and an outer cylinder, of similar length.

As a weight reducing measure, the upper and lower rails at least are non-metallic, typically of synthetic plastics materials, which materials are unaffected by cleansing or sterilising fluids, or possibly of timber.

The lower rail is provided with a manually operable latch to latch the lower rail to the third rail.

The third rail, is apertured at suitable intervals for the passage of fixing bolts or screws to secure the side, e.g. to the mattress supporting frame of the cot, or to the base of a divan.

The telescopic struts, e.g. 7 to 15 in number, are located at such spacing as to prevent a child or infant, or the head of a patient, passing between adjacent struts.

For use with a cot, a first embodiment of side incorporates a manually operable latching means at each end of the upper rail; each latching means comprises a retractable pin; and the cot is provided with vertical end columns having a series of spaced holes, so that a selected hole may be engaged by the pin to deploy the side frame at a required height.

A cot, in accordance with the second aspect is provided with two cot ends, which may be fixed or may be wholly removable.

For use on a bed, such as a domestic divan, no vertical columns exist (or can readily be provided) to which the side frame can be selectively latched in a partially, or fully deployed position; then a second embodiment of side frame has, at least, one biassing strut preferably in the form of a gas strut, capable of maintaining the side frame in a fully, or partially, deployed position, with means for manually rendering the force exerted by the biassing strut inoperative when retraction, by lowering, of the side is required.

The gas strut is rendered inoperative by manual release of gas.

As adult hospital beds or domestic divans are typically 6 ft (2 meters) in length, the sides, in accordance with the invention, are approximately 3 ft (1 meter) in length, so that each adult bed or divan would require four sides, whereby each side may be lowered in turn as and when access is required; telescoping of relatively short length sides is a simpler operation for hospital staff or carer, whilst lightweight/thinner gauge materials may be employed when sufficient rigidity over only 3 ft (1 meter) is required.

The upper rail is provided with at least one elongate through hole, constituting a handgrip for use in manoeuvring the side.

Figure 2:
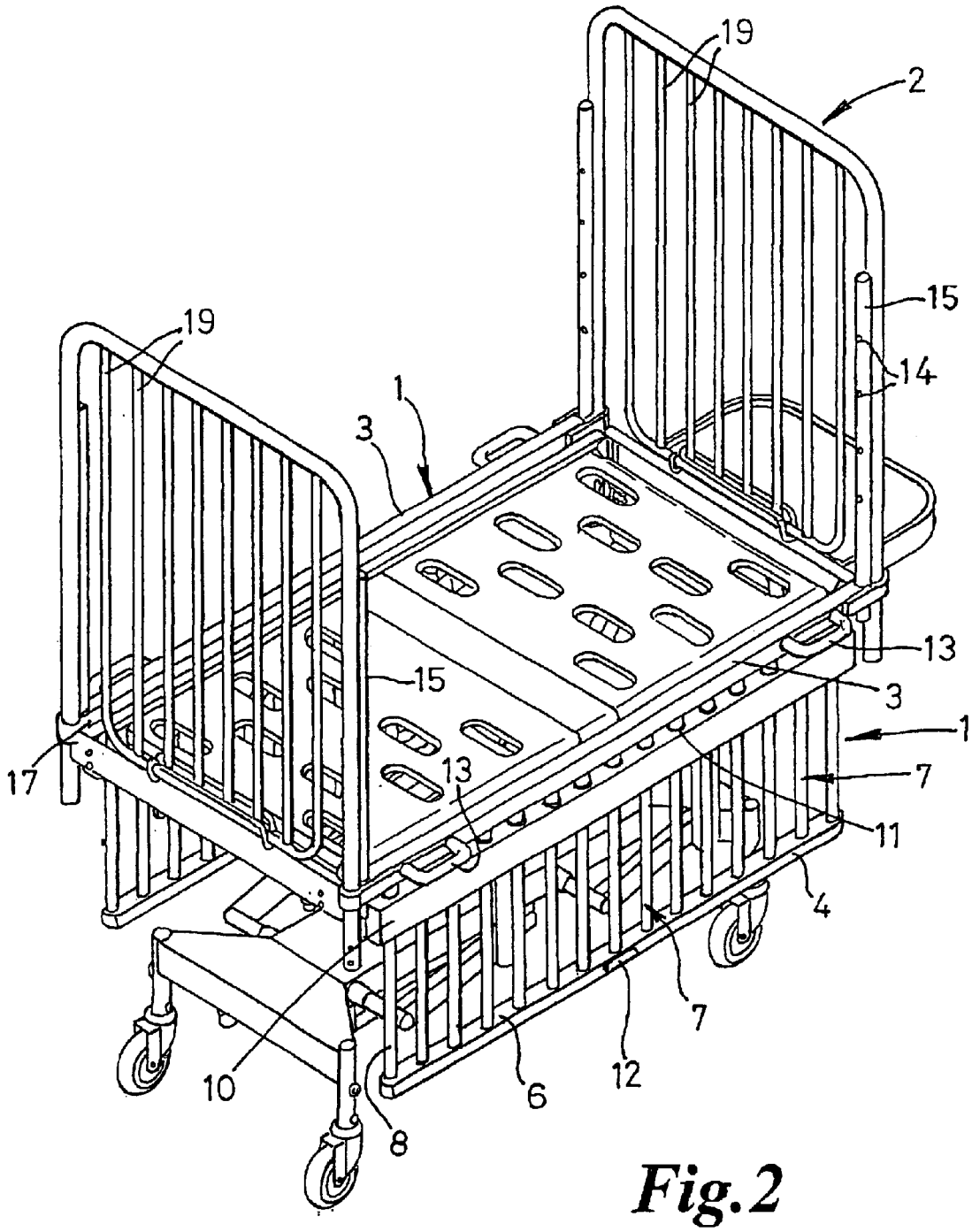
Figure 3:
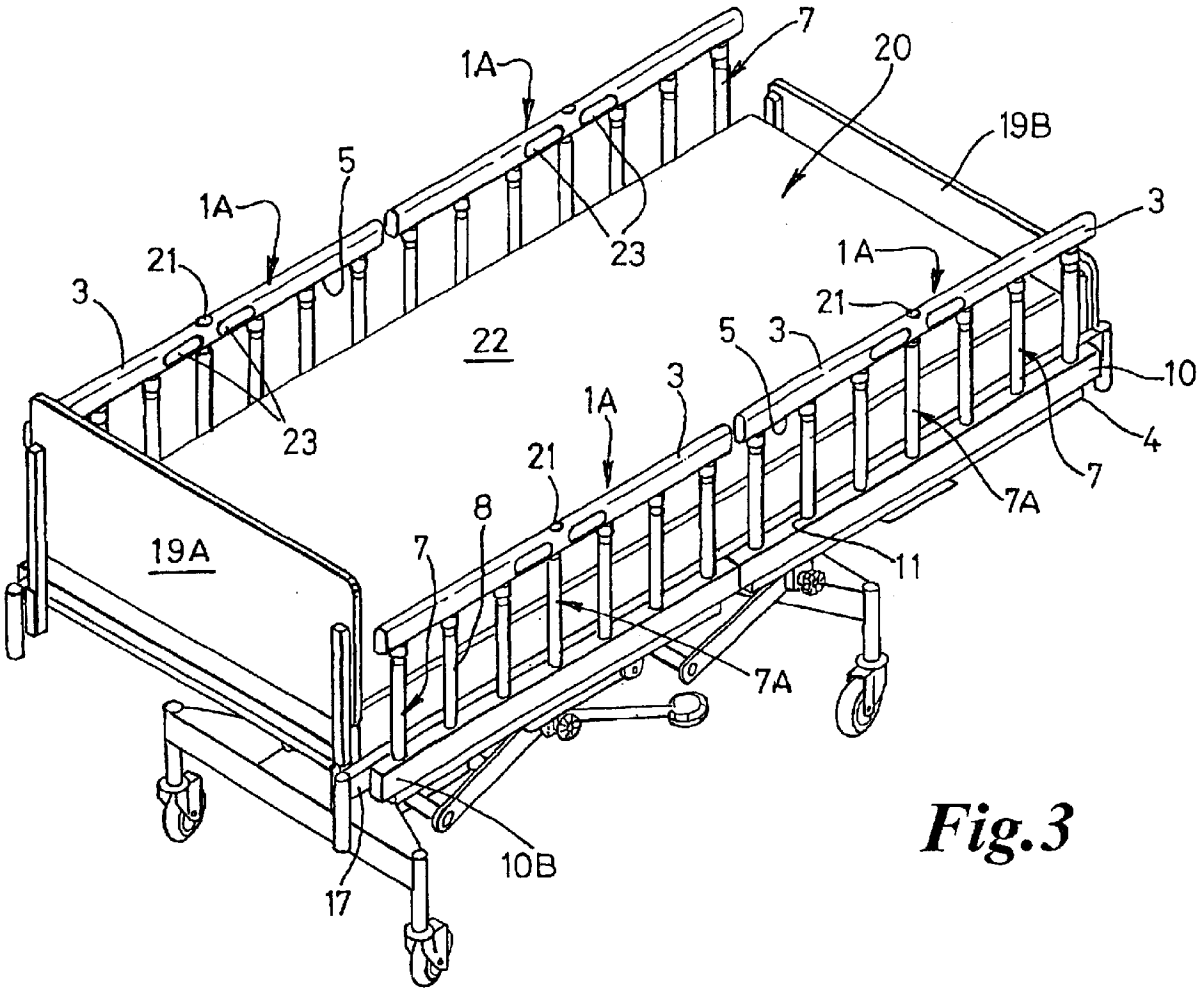
Figure 4:
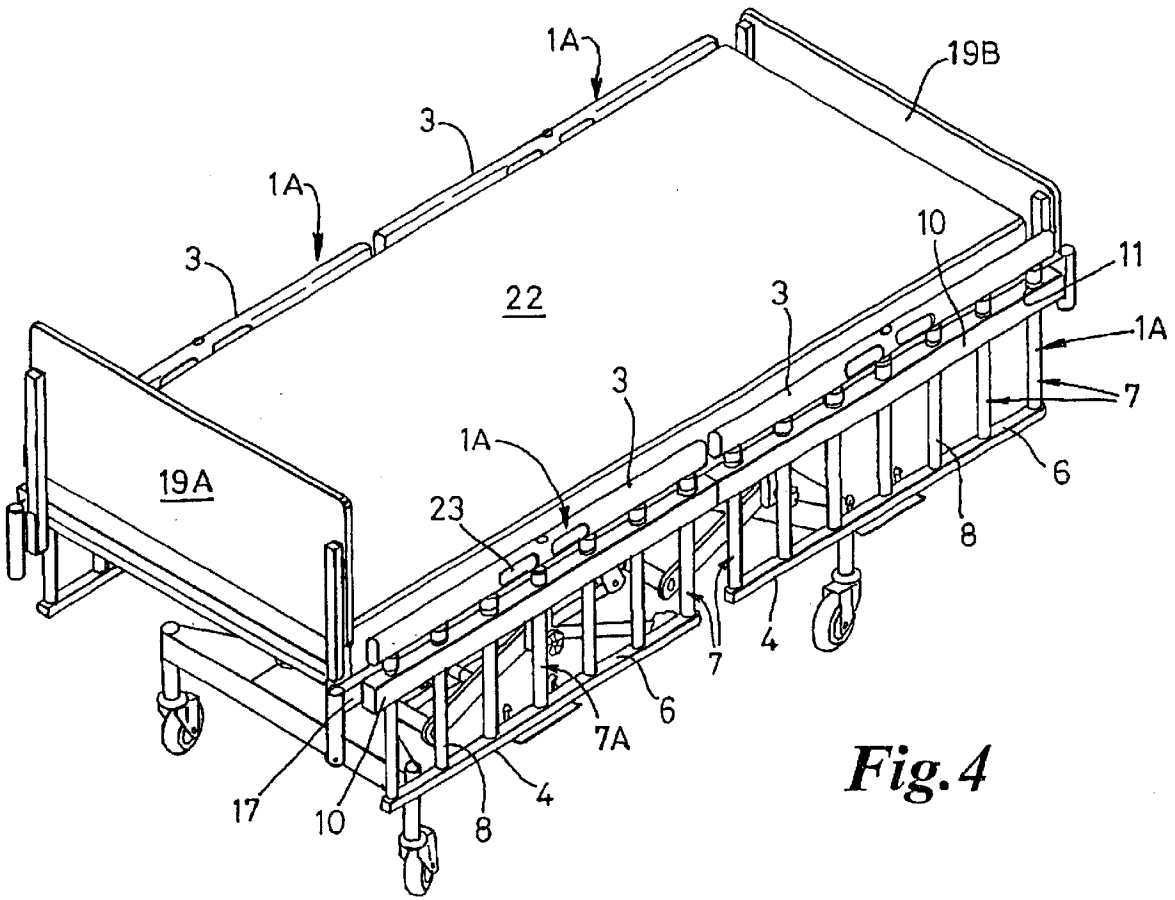

The invention will now be described in greater detail by way of examples, with reference to the accompanying drawings, in which:

FIGS. 1 and 2 are perspective views of an infant's cot, in accordance with the second aspect of the invention, provided with two side frames in accordance with the first aspect of the invention; and FIGS. 3 and 4 are perspective views of an adult bed also in accordance with the second aspect provided with four modified side frames in accordance with the first aspect.

In all figures, like components are accorded like reference numbers.

A side frame (1) for attachment to a cot (2) comprises upper and lower parallel rails (3), (4), with mutually facing edges (5), (6) interconnected by a plurality of telescopic struts (7), each comprising an outer tube or cylinder (8) and an inner cylinder or rod (9) adapted to be telescoped into, or out of, outer cylinder (8).

A third parallel rail (10) is interposed between the upper and lower rails (3), (4) and is provided with a plurality of through apertures or holes (11), of such diameter that the outer cylinder (8) may readily slide through the holes.

The lower rail (4) is provided with a manually operable latch (12) whereby, in the disposition illustrated in FIGS. 1 to 4 with the lower rail (4) abutting the third rail (10), the lower rail may be latched to the third rail (10).

The upper rail (3) is provided, adjacent each end, with a manually operable, spring-loaded 'D'-shaped latch handles (13) having a horizontally displaceable, retractable pin engageable in a selected one of a plurality of holes (14) provided at spaced-apart locations up vertical columns (15) attached to the cot (2).

In FIG. 1, the side frame 1 is illustrated in its fully deployed position, with the lower rail (4) abutting, and latched to, the third rail (10), and with the telescopic struts (7) fully extended.

The upper rail (3) may be selectively lowered, in a first stage, and hence the side frame (1) may be partially collapsed by operation of the latch handles (13) to cause engagement/disengagement of the pins with selected holes (14) until edge abuts upper ends (16) of the outer cylinders (8) when first stage lowering has been completed.

Further lowering of the upper rail (3), will, after manual release of the latch (12), result in commencement of second stage lowering, with the outer cylinder (8) beginning to pass through the holes (11) in the third rail (10), and the lower rail (4) moving away from the third rail (10), until the fully lowered position, permitting maximum access, is attained, as illustrated in FIG. 2.

The third rail is secured to a side rail (17) of a mattress support frame (18), with the frame (18) also carrying fixed or removable end frames (19).

In FIGS. 3 and 4, a bed (20), unlike the cot (2) of FIGS. 1 and 2, has no columns (14) (nor provision for fitting such columns) to which the upper rail (3) may be latched in a selected position.

Consequently, modified sides (1A) are employed, in which one of the telescopic struts is a biassing strut, preferably in the form of a gas strut (7A), with gas pressure urging the strut (7A) to its extended position and hence biassing the side frame to its upper position, whilst a release button (21) is recessed into the upper rail (3). Because the adult bed (20), in contrast to an infant's cot, is of relatively long length, typically 6 ft (2 meters), the sides (1A) have a length of approximately 3 ft ((1 meter), so that four sides (1A) are used per bed (20). Because of the reduced span of a 3 ft side (1A), thinner walled, and hence lighter weight materials may be employed for the rails 3, 4, 9, and the struts (7). Also indicated are fixed or removable headboard and footboard (19A) and (19B), respectively, a mattress (22), and a pair of through holes (23) for manual manoeuvring of the side frames (1A) upwardly and downwardly.

What is claimed is:

1. A side frame for a cot or bed, particularly, but not exclusively, for hospital use, comprising upper and lower rails located in spaced-apart, parallel relationship and of length required for the side frame, with said rails interconnected by a plurality of spaced-apart, transversely extending, telescopic struts, and with a third, parallel rail interposed between said upper and lower rails and with an outer tube or cylinder of each said strut slidable through apertures in said third rail, with said side frame being collapsible, in a first stage from a fully extended, maximum height position, by approximately half of said height, by telescoping said telescopic struts into one another to provide partial access/constraint, and being further collapsible, in a second stage, by sliding said outer tubes or cylinders of said telescopic struts through their receiving holes in said fixed position, third rail, to provide full access/no constraint, the stage of collapse being determined by the requirements of the user.

2. A side frame as claimed in claim 1, wherein said struts are metallic.

3. A side frame as claimed in claim 1, wherein said struts are timber.

4. A side frame as claimed in claim 1, wherein said struts are of plastics.

5. A side frame as claimed in claim 1, wherein said struts comprise an inner tube and an outer tube both of similar length.

6. A side frame as claimed in claim 1, wherein said struts each comprise in another embodiment an inner rod, and an outer tube both of similar length.

7. A side frame as claimed in claim 1, wherein said upper and lower rails at least are of synthetic plastics materials.

8. A side frame as claimed in claim 1, wherein said third rail is apertured at suitable intervals for the passage of fixing bolts or screws to secure said third rail, to a mattress supporting frame of the cot, or to a base of a divan.

9. A side frame as claimed in claim 1, for use with a cot, comprising a manually operable latching means at each end of said upper rail, each said latching means comprises a retractable pin, and vertical end columns of the cot provided with a series of spaced holes, so that a selected hole may be engaged by said pin to deploy said side frame at a required height.

10. A side frame as claimed in claim 1, wherein at least one of said telescopic struts is in the form of a gas strut, capable of maintaining said side in a fully or partially deployed position, with means for manually rendering said gas strut inoperative when retraction, by lowering said side frame, is required.

11. A side frame as claimed in claim 10, wherein the or each of said gas strut(s) is rendered inoperative by manual release of gas.

12. A cot provided with at least one side frame comprising upper and lower rails located in spaced-apart, parallel relationship and of length required for the side frame, with said rails inter-connected by a plurality of spaced-apart, transversely extending, telescopic struts, and with a third, parallel rail interposed between said upper and lower rails and with an outer tube or cylinder of each said strut slidable through apertures in said third rail, with said side frame being collapsible, in a first stage from a fully extended, maximum height position, by approximately half of said height, by telescoping said telescopic struts into one another to provide partial access/constraint, and being further collapsible, in a second stage, by sliding said outer tubes or cylinders of said telescopic struts through their receiving holes in said fixed position, third rail, to provide full access/no constraint, the stage of collapse being determined by the requirements of the user.

13. A cot according to claim 12, provided with two cot ends, which ends are fixed or are removable.

14. An adult bed or divan, wherein each side of said bed or said divan is provided with one or two side frames comprising upper and lower rails located in spaced-apart, parallel relationship and of length required for the side frame, with said rails inter-connected by a plurality of spaced-apart, transversely extending, telescopic struts, and with a third, parallel rail interposed between said upper and lower rails and with an outer tube or cylinder of each said strut slidable through apertures in said third rail, with said side frame being collapsible from a fully extended, maximum height position, by approximately half of said height, in a first stage by telescoping said telescopic struts into one another to provide partial access/constraint, and being further collapsible, in a second stage, by sliding said outer tubes or cylinders of said telescopic struts through their receiving holes in said fixed position, third rail, to provide full access/no constraint, the stage of collapse being determined by the requirements of the user, wherein at least one of said telescopic struts is in the form of a gas strut, capable of maintaining said side in a fully or partially deployed position, with means for manually rendering said gas strut inoperative when retraction, by lowering said side frame, is required.

* * * * *